US005564941A

United States Patent [19]

Norden

[11] Patent Number: 5,564,941

[45] Date of Patent: Oct. 15, 1996

[54] INSULATION DISPLACEMENT CONNECTORS

[75] Inventor: Alexander R. Norden, Boca Raton, Fla.

[73] Assignee: Eugene A. Norden, New York, N.Y.

[21] Appl. No.: 280,335

[22] Filed: Feb. 25, 1994

Related U.S. Application Data

[63] Continuation-in-part of Ser. No. 29,439, Mar. 3, 1993, abandoned.

[51] Int. Cl.[6] ..... H01R 4/24

[52] U.S. Cl. ..... 439/410; 439/395

[58] Field of Search ..... 439/409–414, 439/417–419, 395, 404, 709–713

[56] References Cited

U.S. PATENT DOCUMENTS 2,908,804 8/1955 Wirsching .
3,521,221 7/1970 Lenaerts et al. .
4,157,208 6/1979 Roberts .
4,306,759 12/1981 Norden .
4,764,124 8/1988 Simon .
4,929,190 5/1990 Gonon .
4,932,892 6/1990 Scherer .

*Primary Examiner*—David L. Pirlot

[57] ABSTRACT

Two forms of insulation-displacement connection devices and panels of such devices are disclosed; the connection devices of each of the panels include upstanding connectors bent to provide paired wire-gripping finger portions in a plane parallel to the related panel. Each form of the connecting devices includes a rotor operable about an axis perpendicular to the related panel, the rotor being arranged to drive upstanding inserted wires broadside—parallel to the rotor's axis—from starting positions opposite to the ends of the pairs of wire-gripping finger portions to end positions gripped between the wire-gripping finger portions. The wire's insulation is displaced and the center conductor of the wire is bared locally as the wire is forced between the wire-gripping finger portions. In both embodiments, there are two pairs of wire-gripping finger portions, at opposite sides of the rotor's axis. The free ends of the wire-gripping portions are pre-biased toward each other, for augmenting the insulation-displacement forces of the paired wire-gripping finger portions.

34 Claims, 7 Drawing Sheets

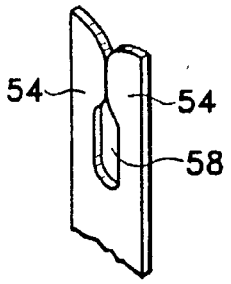
Fig. 17
(Prior Art)
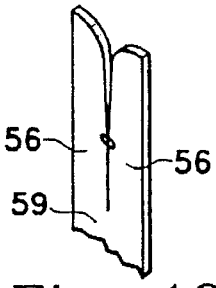
Fig. 18
(Prior Art)
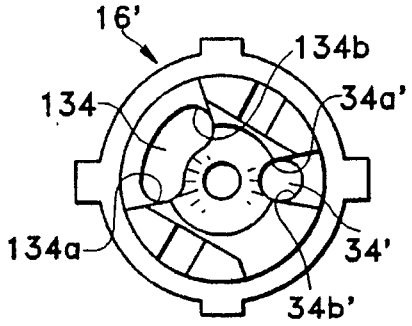
Fig. 24
Fig.19
(Prior Art)
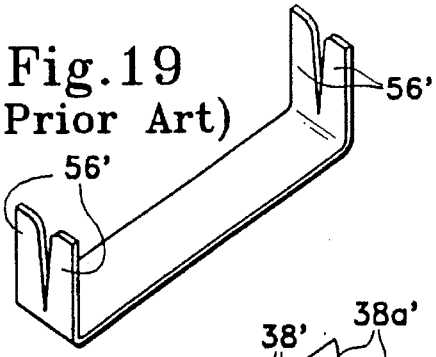
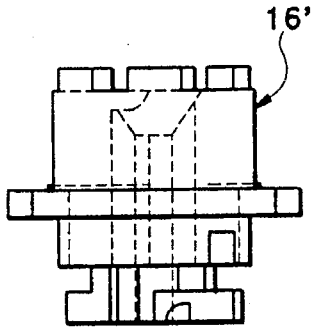
Fig. 25
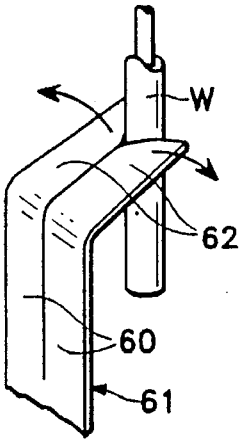
Fig. 20
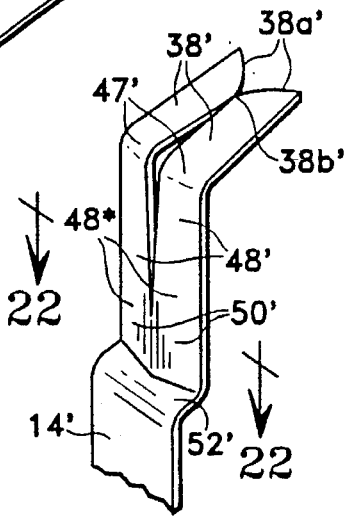
Fig. 21
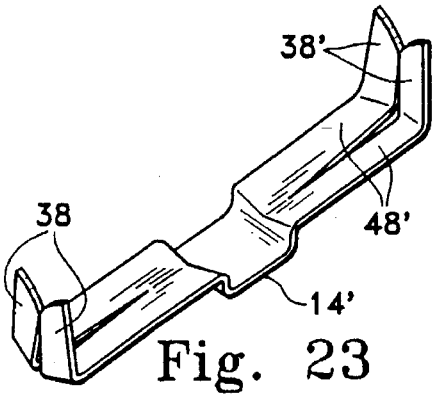
Fig. 23
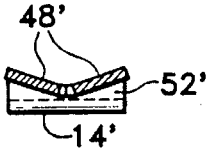
Fig. 22
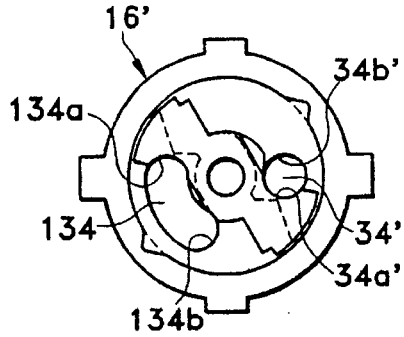
Fig. 26

INSULATION DISPLACEMENT CONNECTORS

This is a continuation-in-part of application Ser. No. 08/029,439 filed Mar. 3, 1993.

The present invention relates mainly to insulation-displacement connectors ("IDC's") and, while it will be recognized that certain aspects of the invention are more generally applicable, the following specification is addressed to IDC's and to panels of such connectors.

BACKGROUND OF THE INVENTION

A screw-and-post form of connector panel has been in use in telephone systems for quite some time. It includes a base of insulation that bears a pattern of metal posts. Below the base, each post has a "wire-wrap" terminal; and above the base, a screw is threaded into the top of the post. In using such connector panels, the end portion of each wire must first be stripped of insulation. The bared wire end is bent around a screw which is then tightened to connect the wire securely to the post. Washers under the screw head allow two wires to be connected to a single post. The screws are accessible by test probes. In addition, standardized test blocks are widely used in manufacturing plants and in the field, having a pattern of spring-loaded contact pins matching the pattern of screw terminals of the connector panels.

In widely prevalent practice, IDC connectors—insulation-displacement connectors—replace the screw-and-post connectors just described. An IDC connector for a telephone connector panel consists of a strip of metal having a wire-wrap terminal at one end and paired resilient wire-gripping fingers formed by slitting a contact strip lengthwise. The ends of the fingers form a "V". In use, an insulated wire is laid across the "V" and forced broadside between the slit edges of the resilient fingers. The fingers are stiff enough so that the inner conductor of the wire is bared where it is gripped by edges of the fingers. With careful design, the fingers are sufficiently resilient so that the insulation on the wire is crushed between the opposite slit edges of the connector; the inner conductor is gripped between the edges without exceeding the elastic limit of the metal strip. With careful design, such connectors can be made that do not cut deeply into and weaken solid wire. A slit-strip connector can be designed for both solid and stranded wire.

Slit-strip or IDC connectors are known which bear caps of insulation for driving wires into place between slit edges, in the process cutting or crushing the wire's insulation. The cap has a cross hole for admitting a wire. With the wire in place, the cap is forced down and along the slit-finger connector for driving the wire between the slit fingers. Such insulating caps are intended for labor-saving convenience. However, a panel of close-spaced IDC connectors bearing wire-driving caps as shipped to a user are not ready for wiring. In order to insert a wire into a connector near the center of the pattern, it is first necessary to depress the caps of some adjacent connectors in order to provide access to that terminal which is to be used. Later, when one of the close-spaced connectors having a depressed cap is to be wired, that cap must first be pried up. Moreover, making individual test connections to IDC connectors bearing insulation caps may be difficult; a test clip or probe may or may not be usable. However, the insulating caps rule out use of a test block having a pattern of resilient contact pins matching the pattern of slit-strip connectors of the panel.

It is possible to construct a panel of IDC slit-finger connectors having dual slits. Each pair of fingers securely grips a respective inserted wire; inserting a wire between a second pair of fingers of a dual IDC connector does not disturb a wire previously gripped by a first pair of fingers of that IDC connector. Connectors having dual slits are wider than single-slit connectors. Therefore, the pattern of connectors in a panel of single-slit connectors ordinarily differs from the pattern of dual-slit connectors, requiring two different blocks of test probes.

SUMMARY OF THE INVENTION

The illustrative IDC or slit-strip connector and the panel of such connectors described in detail below and shown in the accompanying drawings provide the basic attributes of known IDC panels. However, the novel IDC connectors and panel of novel connectors provide a number of additional attributes and incorporate a number of novel structural features.

Two panels of novel IDC connectors are described in detail below as illustrative embodiments of several aspects of the invention. In both illustrative embodiments, the panel bears a pattern of elongated upstanding connectors that are made of sheet metal. Each connector is contained in a hollow post of insulation that projects from a base. One end of each elongated connector is fixed in the base, which is of insulation. At the end of the connector remote from the panel—the "free end" of the connector—the connector is slit lengthwise into a pair (at least one pair) of fingers. Both fingers of a pair are divided by bends into a pair of upstanding support finger portions and a pair of transverse wire-gripping IDC finger portions. When a wire is to be secured to the connector, the end portion of the wire is aimed toward the panel and it is driven, broadside, between the wire-gripping edges of a pair of wire-gripping fingers. The length of the wire that provides circuit connection to the connector is bent so that such circuit wire extends from the connector across the panel. Notably, the end portion of the gripped wire aims downward from the wire-gripping fingers, along the upstanding portion of the connector toward the panel. In this configuration of the connector and its IDC wire-gripping fingers, the end portions of the gripped wires are tucked away incidental to the wire being driven into the IDC wire-gripping finger portions.

In a further aspect of the invention, a rotor is operable about an axis that is fixed in relation to a pair of IDC wire-gripping fingers, arranged to drive an end portion of wire broadside into a slit-strip pair of fingers. Turning the rotor causes a driving portion of the rotor to force an end portion of a wire broadside between the wire-gripping edges of a pair of IDC fingers. In the illustrative embodiments of the invention, the connector is contained in a hollow post of insulation. In one embodiment of the invention, the rotor turns on a pivot extending from the connector or in a bearing in the post of insulation, or by both. In another embodiment of the invention, the rotor turns about a bearing in the panel. In each embodiment, the rotor is operable by a screwdriver or equivalent tool that enables controlled driving force to be applied to the rotor for driving an end portion of the wire broadside between wire-gripping fingers and, for insulated wire, to displace the insulation so as to bare the inner conductor of the wire where it is gripped. In both of the illustrative embodiments of the invention that are described in detail below, the rotor drives two wires into two pairs of wire-gripping IDC finger portions.

A panel of connectors having slit-strip fingers and rotors for driving inserted wires between the paired fingers, where the rotor axes are perpendicular to the panel, has a further attribute. The panel can be shipped to the user in condition for wiring. Insertion of any wire and driving the inserted wire between the wire-gripping fingers of any connector by means of such rotor can be performed for each connector of the panel without interference or obstruction by other connectors of the panel. (This contrasts with known IDC connectors having upstanding slit-strip wire-gripping fingers bearing wire-drivers. operable toward and away from the connector panel; (there, when a wire is to be inserted, the wire drivers of closely neighboring connectors must first be depressed.)

The plane of a slit-strip pair of wire-gripping fingers can be related variously to the axis of a wire-driving rotor. For example, the rotor's axis may be parallel to but spaced from the plane of a slit-strip pair-of fingers. Also (in both illustrative embodiments of the invention) the rotor's axis may be perpendicular to the plane of the slit-strip pair of fingers, the axis being spaced from the wire-receiving slit. The benefit of the rotor as a wire driver can be realized with either of those configurations.

The use of a rotor for driving a wire between slit-strip fingers has a further distinctive attribute. By providing the rotor with both a wire-driving portion and a companion wire-removing portion, the rotor becomes operable in one direction to force a wire into the grip of a pair of wire-gripping fingers, and the rotor is also operable in the reverse direction to remove a gripped wire from the fingers.

It may be critical in some situations that one wire is to remain securely connected by a pair of wire-gripping connectors, yet it may become necessary to disconnect another wire that is then gripped by another pair of fingers related the same rotor. This is achievable by using a rotor having only one wire-removal portion companion to one of its two wire-driving portions.

One illustrative embodiment of the invention utilizes a rotor for each finger-bearing connector of a panel, the connectors being upright and the rotors resembling caps on the connectors and being operable and accessible for operation from above the panel by a screwdriver or equivalent tool. In addition, without increasing the space requirement of a connector with its pair of wire-gripping fingers and its rotor, the connector in this embodiment of the invention bears a second pair of wire-gripping fingers that are served by the same wire-driving rotor.

In the second illustrative embodiment of the invention, one rotor serves a pair of upstanding connectors, each contained in its hollow post of insulation.

In the first embodiment of the invention described below in detail, the novel connector has an upstanding axial projection and the rotor, made of insulation, has an aperture through which that projection extends. That extension serves in part as a pivot for the rotor. However, it also constitutes an exposed test terminal of the connector. The test terminal is notched near its tip, to provide for a stable grip by jaws of a test clip. Additionally, that exposed projection serves as a test terminal engageable by one of many resilient contacts of a test block. The resilient contacts of the test block and the exposed test terminals of the panel of connection devices have the same pattern, for engagement with each other.

Each connector in one of the illustrative panels of connectors detailed below is erect on its supporting panel of insulation, and each connector has at least one pair of slit-strip wire-gripping fingers that are integral portions of a sheet-metal connector. As noted previously, it is important (and customary) for a pair of wire-gripping fingers—particularly by IDC wire-gripping fingers—to receive a wire forced between them without the IDC connector yielding so far as to take a permanent set. Accordingly, taking the thickness and width of a slit-finger connector into account, as well as the properties of the sheet metal and the thickness of the wire to be gripped, it becomes necessary for the fingers to be of substantial length. The fingers of each pair are appropriately long, but they are bent in order to avoid dedicating a large area of the panel to each pair of fingers. Bending a pair of wire-gripping fingers gives rise to a further problem. At one side of a bend, there is an upright "support finger portion"; each support portion of a finger has a supported end where it extends integrally from the upright portion of the sheet metal connector. At the other side of each bend, each finger has a "wire-gripping finger portion" between the bend and the free end of the finger. When a wire is being forced between the free ends of the wire-gripping finger portions, those finger portions form levers that impose twisting forces on the supporting finger portions. The grip of a wire by the wire-gripping finger portions is limited by the capacity of the supporting finger portions to resist being twisted. The bent-finger configuration inherently develops sharply reduced wire-gripping strength compared to straight slit-strip wire-gripping fingers of the same metal and equal length and width.

As a further aspect of the invention, the wire-gripping force of bent slit-strip fingers is greatly enhanced. One way of enhancing that grid is by forming permanent mutually of opposite twists in the support finger portions of a pair of wire-gripping fingers, the twists being in the directions that pre-bias each wire-gripping finger portion toward the other. This is advantageously accomplished by producing a deformation in the unslit portion of the strip from which the bent wire-gripping fingers extend. Ample wire-gripping force is developed in a manner that avoids development of a permanent set of the fingers when a wire is forced between the wire-gripping fingers and without resort to sheet metal having unusual properties or to slit-strip fingers of increased length, width and thickness.

The deformation at the supported ends of the bent wire-gripping fingers produces a further benefit. The wire-gripping edges bear against each other at their ends farthest from the bends, but elsewhere those wire-gripping edges become spaced apart. The gap between those edges is much less than the thickness of the wire to be gripped, but it is wide enough to be reached by electroplating action. Those wire-gripping edges which are thus exposed are coated with a metal such as tin or gold for enhanced corrosion-resistance and for reduced contact resistance.

The illustrative embodiments of the invention described in detail below, and shown in the accompanying drawings, incorporate many novel aspects which complement each other toward creating exemplary connectors and panels of connectors. It is evident that some aspects of novelty may be utilized without others, as will be appreciated in reviewing the following text together with the accompanying drawings.

BRIEF DESCRIPTION OF THE DRAWINGS

FIGS. 17, 18 and 19 are perspective views of prior connectors, FIGS. 17 and 18 being fragmentary views;

FIG. 20 is a fragmentary perspective view of a portion of the blank of FIG. 16 showing the wire-gripping portion bent at right angles to the support portion of the connector;

FIG. 21 is a fragmentary perspective view of a portion of the connector of FIGS. 2, 14 and 15;

FIG. 22 is a cross-section of one of two portions of the connector of FIGS. 2, 14 and 15, as seen at the plane 22—22 in FIG. 21;

FIG. 23 is a modified form of the connector of FIG. 19, embodying novel aspects of the invention; and FIGS. 24, 25 and 26 being a top plan view and a side elevation and a bottom plan view of a modification of the rotor of FIGS. 2–13. FIG. 24 is the top plan view of a rotor, being a modification of the rotor of FIG. 6;

FIG. 25 is a side elevation of the rotor of FIG. 24; and

FIG. 26 is a bottom plan view of the rotor of FIG. 24,

FIG. 27 is a fragmentary top plan view of a novel connection panel, being an assembly of multiple dual connection devices in FIGS. 28–31;

FIG. 28 is a fragmentary front elevation of one of the novel dual connection devices of FIG. 27;

FIG. 29 is a fragmentary top plan view of the dual connection device of FIG. 28;

FIG. 30 is a vertical cross-section of the dual connection device of FIGS. 28 and 29 as seen from the plane 30—30 in FIG. 29;

FIG. 31 is a front elevation of a rotor, being a component of the dual connection device of FIGS. 27–30;

FIG. 32 is a side elevation of the rotor of FIG. 31, as seen from the left of FIG. 31;

FIG. 33 is a top plan view of the rotor of FIGS. 31 and 32, the top surface being stippled for clarity;

FIG. 34 is a fragmentary cross-section of the rotor of FIGS. 31–33 as seen at the plane 34—34 in FIG. 33;

FIG. 35 is a fragmentary cross-section of the rotor of FIGS. 31–33 as seen at the plane 35—35 of FIG. 33;

FIG. 36 is a bottom plan view of the rotor of FIGS. 31–33;

FIG. 37 is a cross-section of the rotor of FIGS. 31–33 at the plane 37—37 in FIG. 31;

FIG. 38 is a cross-section of the rotor of FIGS. 31–33 at the plane 38—38 in FIG. 31;

FIG. 39 is a fragmentary cross-section of the rotor of FIGS. 31–33, as seen at the plane 39—39 in FIG. 31;

FIG. 40 is a fragmentary top view of the insulating supporting posts of the dual connection device of FIGS. 25–27;

FIG. 41 is a vertical cross-section of the insulating support posts as seen at the interrupted planes 41—41 of FIG. 40;

FIG. 42 is a vertical cross-section of an insulating support post as seen at the plane 42—42 in FIG. 40;

FIG. 43 is a front elevation of an electrical connector, being a component of the connection device of FIGS. 28–31;

FIG. 44 is a side elevation of the electrical connector shown in FIG. 43;

FIG. 45 is a fragmentary elevation of a sheet-metal part at an intermediate stage of the production of the electrical connector of FIGS. 43 and 44; and FIG. 46 is a fragmentary top view of the electrical connector of FIGS. 43 and 44, drawn to larger scale.

DETAILED DESCRIPTION OF ILLUSTRATIVE EMBODIMENTS OF THE INVENTION

Figure 1:
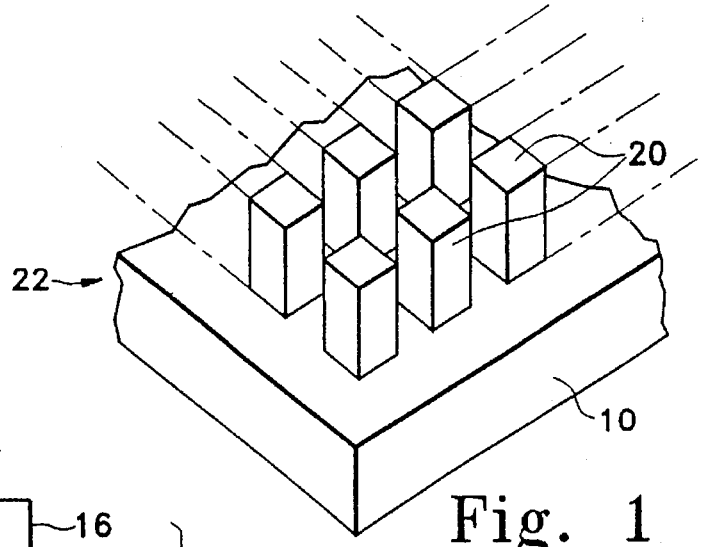
FIG. 1 is a diagrammatic perspective of an illustrative connection panel embodying connection devices shown in detail in FIGS. 2–12.
Figure 2:
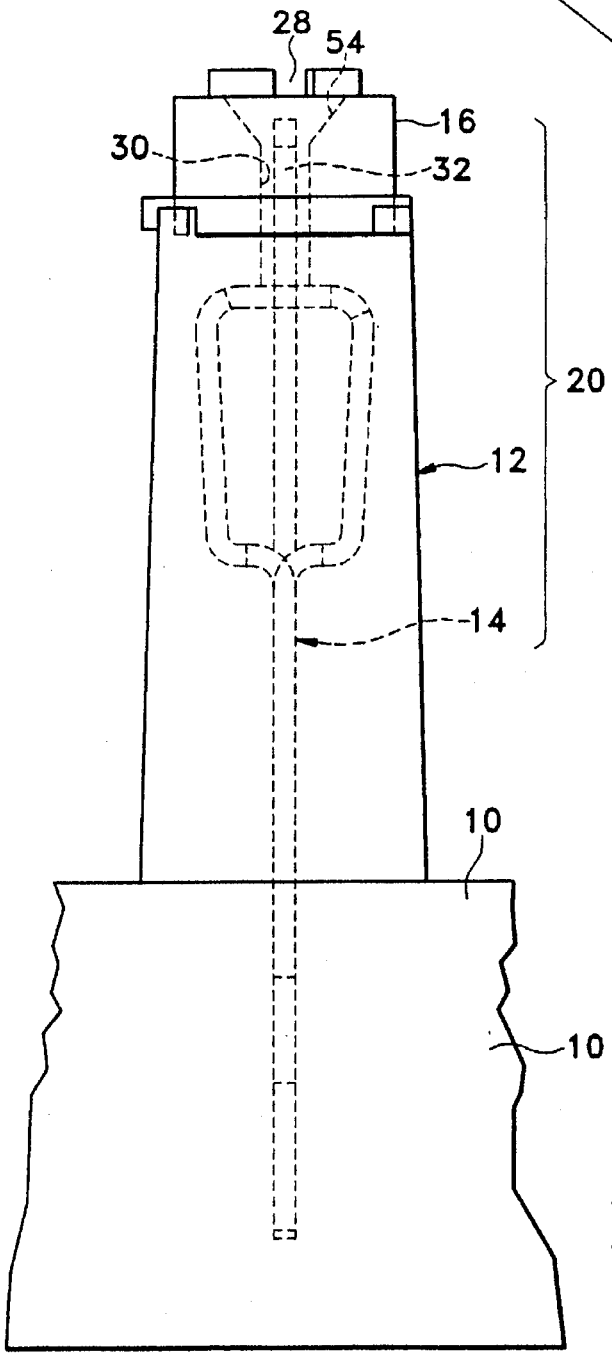
FIG. 2 is a side elevation of an illustrative novel electrical connection device, greatly enlarged.

FIG. 2 represents a side elevation of an illustrative novel connection device, including a base 10 and a hollow post 12 of insulation, an insulation-displacement connector 14 and a rotor 16. Hollow post 12 and base 10 are integral portions of a molded plastic unit. Hollow post 12, connector 14 and rotor 16 form a connection device 20. As seen in FIG. 1, many connection devices 20 integrated with base 10 constitute a panel 22 of connection devices. The spaces between the connection devices are to contain wires (not shown) to the connection devices.

Figure 5:
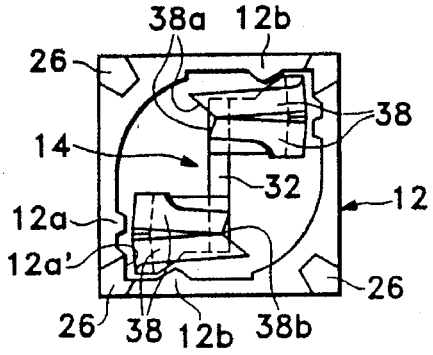
FIG. 5 is a top plan view of the hollow post and the connector of FIG. 4, omitting the rotor shown in phantom in FIG. 4.
Figure 6:
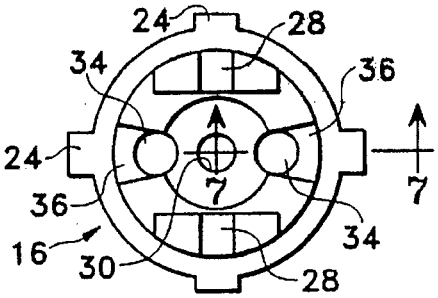
FIG. 6 is a top plan view of the rotor of FIGS. 2 and 3.
Figure 4:
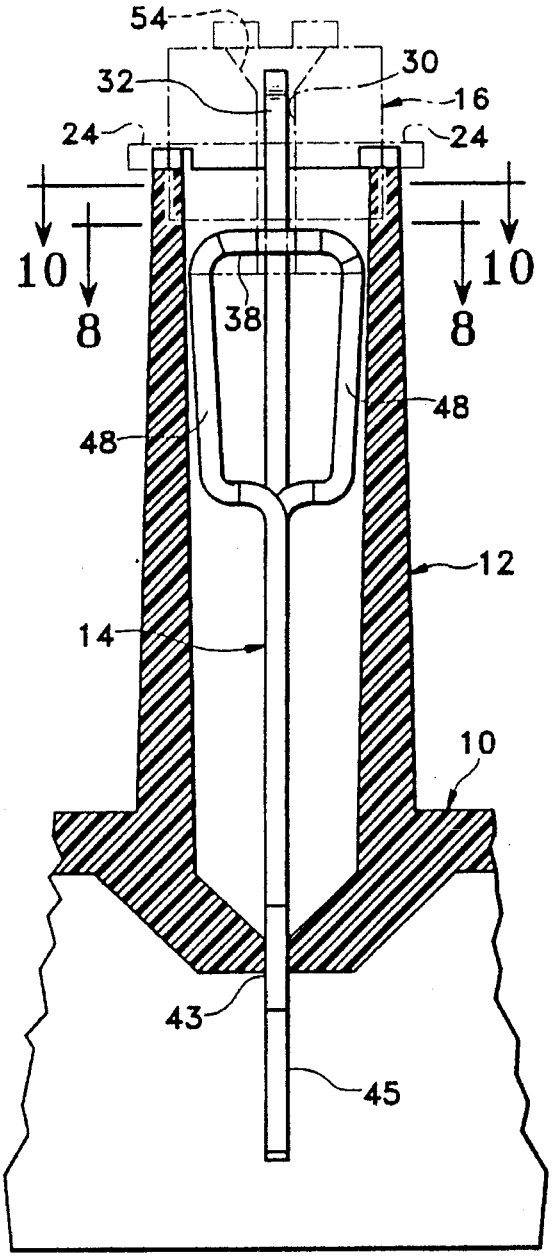
FIG. 4 is a vertical cross-section of the connection device of FIG. 3, showing the relationship of the hollow post and the connector of FIG. 2 in their ultimate relationship, further including a rotor in dotted lines showing the relationship of the rotor to the post and the connector.

Hollow post 12 in FIG. 4 is approximately square externally and roughly oval internally, in cross-section, as best shown in FIG. 5. Connector 14 is shown in hollow post 12 just to show the relationship of parts 12 and 14. Actually (as will be seen in the description below) connector 14 and rotor 16 are put together as a preliminary assembly which is then inserted into hollow post 12. Omitting rotor 16 from FIG. 5 (and showing rotor 16 only in phantom in FIG. 4) provides the unencumbered view of connector 14 in post 12 that appears in FIG. 5.

Figure 3:
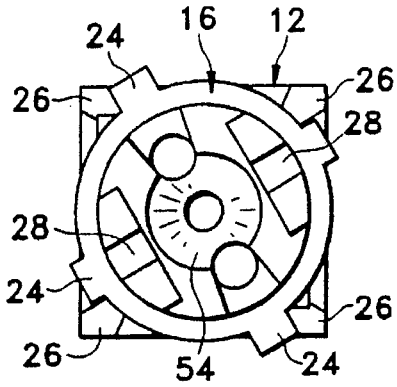
FIG. 3 is a top plan view of the connection device of FIG. 2, in condition for insertion of one or two wires.

Rotor 16 is made of molded plastic insulation. As seen in FIG. 3 (and other Figures) rotor 16 has four projections 24 that extend outward, and hollow post 12 has four abutments 26. Each projection 24 is movable between arcuate limits fixed by abutments 26, so that rotor 16 can be moved back and forth through an angle of about 60° in this example. The top of rotor 16 has formations that define diametrically opposite portions 28 of a screwdriver slot.

Figure 7:
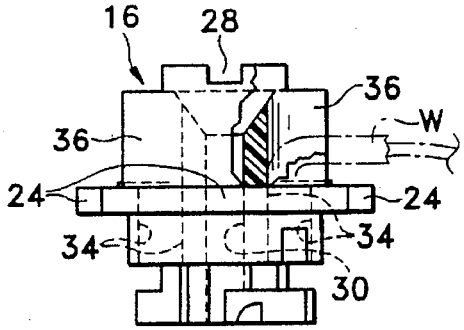
FIG. 7 is a side elevation of the rotor of FIG. 6, a portion being broken away and shown in cross-section at the plane 7—7 in FIG. 6, further including an inserted wire shown in phantom.

Rotor 16 has a centered bore 30 in which an elongated pivot 32 is received. Pivot 32 is an integral portion of connector 14. Diametrically opposite wire-receiving holes 34 extend parallel to bore 30 through the lower portions of the rotor. Each hole 34 becomes an outwardly divergent cavity 36 in the upper portion of the rotor. At the right in FIG. 7, a wire W is shown, the end of the wire having been guided by cavity 36 into hole 34. In practice, a straight end portion of an insulation-sheathed wire W is directed, downward into hole 34 via guide cavity 36, and then the part of the wire in cavity 36 is bent outward.

Figure 8:
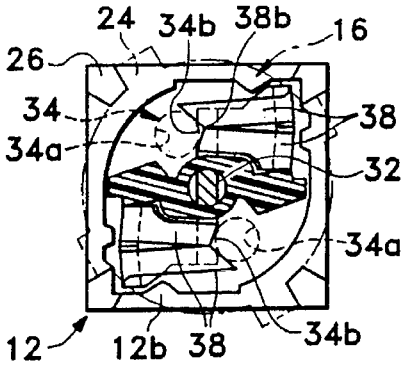
FIG. 8 is a cross-section at the plane 8—8 in FIG. 4 through the rotor and the hollow post of FIG. 2 with the rotor in its "open" or wire-receiving position, a portion of the rotor above plane 8—8 appearing in phantom.

As best shown in FIG. 5 (where rotor 16 is omitted) and in FIG. 8, connector 14 has two pairs of wire-gripping finger portions 38; end formations 38*a* of finger portions 38 converge to a point of contact 38*b* where the finger portions 38 of each pair abut each other. When rotor 16 is in the position shown in FIG. 8, the connection device 20 is "open" ; holes 34 in the rotor are located so that wires can be inserted into the holes, unobstructed by finger portions 38. Wires (not shown in FIG. 8) are received in holes 34, opposite to the converging end formations 38*a* (FIG. 5) of the pairs of finger portions 38.

Figure 9:
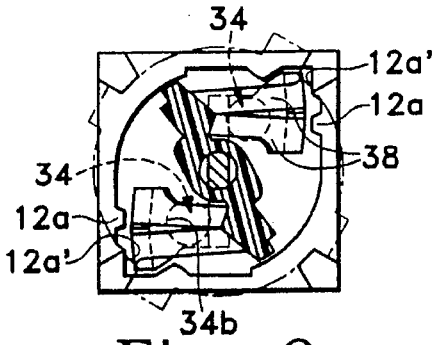
FIG. 9 is a cross-section corresponding to FIG. 8 with the rotor in its "closed" or wire-gripping position.

Rotor 16 may be turned in an arcuate wire-insertion stroke by means of a screwdriver in slot 28—28, shifting holes 34 into positions opposite to finger portions 38 as seen in FIG. 9. Finger portions 38 have mutually opposite edges for gripping an inserted wire (not shown in FIG. 9). As is explained more fully below, turning rotor 16 in a wire-inserting arcuate stroke from its position shown in FIG. 8 toward the position shown in FIG. 9 causes wire-driving portions 34*a* (FIG. 8) at the "back" of each hole 34 to force wires (when present in holes 34) against converging formations 38*a* of the finger portions 38. Continued movement of rotor 16 to the position of FIG. 9 forces each wire between the wire-gripping edges of each pair of finger portions 38 removing the insulation of wire W at those edges.

As the driving portion 34*a* at the "back" of each hole 34 forces the wire between a pair of finger portions 38, that force tends to shift each pair of finger portions 38 in the direction of movement of holes 34. Abutment portions 12*a* and 12*a'* of hollow post 12 (FIG. 9) block such motion of contact portions 38.

Rotor 16 is operable reversely in a wire-releasing stroke, to carry holes 34 from the position in FIG. 9 to that of FIG. 8. In that motion, "front" portions 34*b* of holes 34 drive the wire out of the wire-gripping edges of finger portions 38. There is a tendency of the finger portions 38 to be deflected in the direction of motion of holes 34, the wire-releasing direction. That tendency results from wires W being forced in the wire-releasing direction while they are gripped by finger portions 38. This deflection is blocked by abutment portions 12*b* of the hollow post.

Figure 10:
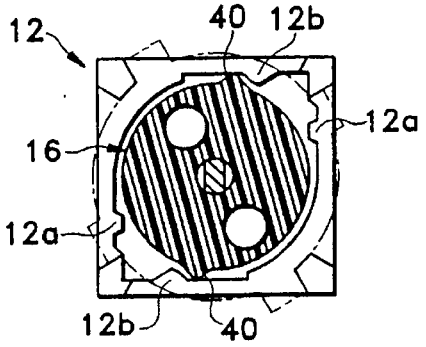
FIG. 10 is a cross-section at the plane 10—10 in FIG. 4 through the rotor and the hollow post of FIG. 2 with the rotor in its "open" or wire-receiving position, a portion of the rotor above plane 10—10 appearing in phantom.
Figure 11:
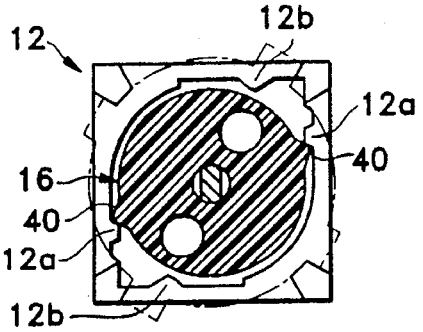
FIG. 11 is a cross-section corresponding to FIG. 10 with the rotor in its "closed" or wire-gripping position.
Figure 12:
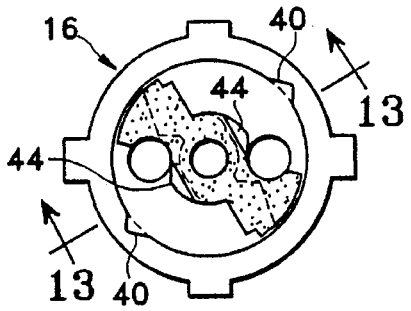
FIG. 12 is a bottom plan view of the rotor, that portion of the rotor which is lowermost being stippled for clarity.

As indicated above, projections 24 are arrested by abutments 26 to limit the wire-inserting stroke and the wire-releasing stroke of rotor 16. Detents are provided for holding the rotor 16 in each of its extreme "open" or "closed" positions (FIGS. 8 and 9). For this purpose, rotor 16 bears a pair of diametrically opposite longitudinal ribs 40 (FIGS. 10–12). At the end of the wire-releasing stroke of rotor 16, coaction of ribs 40 with detents 12*b* blocks rotor 16 against clockwise rotation. At the end of the wire-inserting stroke of rotor 16, ribs 40 coact with detents 12*a* to block rotor 16 against turning counterclockwise To shift from "open" (FIG. 10) to "closed" (FIG. 11), rotor 16 is forced clockwise. Ribs 40 drive detents 12*b* outward as the ribs start to move toward detents 12*a*. The walls of hollow post 12 yield sufficiently for detents 12*b* to be forced outward as rotor 16 forces ribs 40 to pass detents 12*b*. To complete the wire-inserting stroke, the rotor's ribs 40 are forced to pass detents 12*a* (the walls of hollow post yielding as necessary) and then rotor 16 is held at the endpoint of its wire-inserting stroke.

In the wire-releasing stroke of rotor 16, the walls of hollow post 12 yield sufficiently for ribs 40 to deflect detents 12*a* and 12*b* outward in succession. Upon completion of the counterclockwise arcuate wire-releasing stroke of the rotor (as viewed in FIG. 8, for example) ribs 40 have been forced past detents 12*b*, holding the rotor at that position, the end of the wire-releasing stroke.

Figure 13:
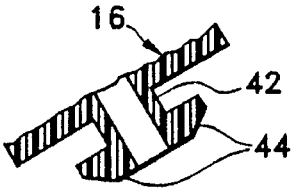
FIG. 13 is a fragmentary cross-section of the lower-most portion of the rotor as seen at the plane 13—13 in FIG. 12.
Figure 27:
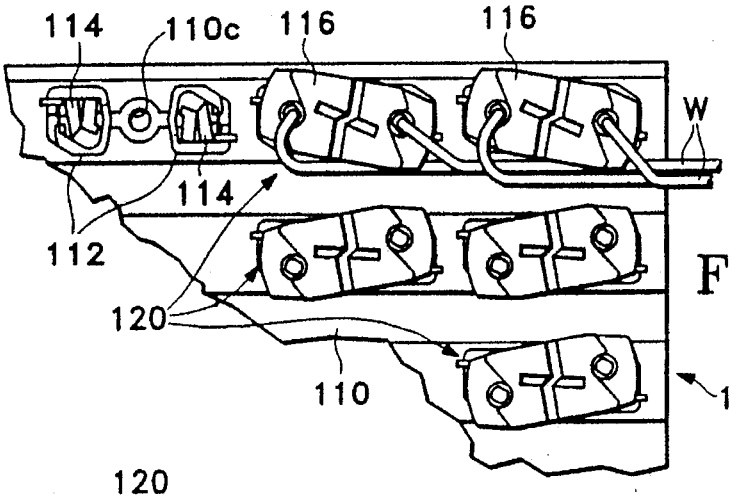
FIGS. 27–46 are enlarged views of a further illustrative embodiment of various aspects of the invention in FIGS. 1–16 and FIGS. 21–26, this embodiment incorporating further aspects of the invention.

Rotor 16 is assembled to connector 14 before the connector has been inserted into hollow post 12. Rotor 16 has a lowermost portion, best shown in FIG. 13. Plane 8—8 in FIG. 4 intersects necked-in portion 42 of the rotor in FIG. 13. The radially innermost wire-gripping finger portion 38 of each pair of these finger portions is close to pivot 32 (FIG. 8). Those two finger portions are received in necked-in portion 42 of the rotor, holding the rotor assembled to connector 12. As seen in FIGS. 12 and 13, the lowermost portion of rotor 16 has cams 44. In an initial assembly operation, rotor 16 is placed on pivot 32 and forced down. Cams 44 drive the innermost finger portions 38 outward until those finger portions reach the necked-in portion 42 of the rotor, whereupon the edges of finger portions 38 nearest to the axis of rotor 16 snap into the necked-in portion 42. Other means for retaining rotor 16 assembled to the connection device 20 may be adopted.

After electrical connector 14 and rotor 16 have been assembled, that subassembly is inserted into hollow post 12. The lowermost end of connector 14 has formations 43 that are forced through an aperture in base 10, retaining connection device 20 assembled to the base. A wire-wrap terminal 45 projects into a cavity in base 10, accessible for wiring.

Figure 15:
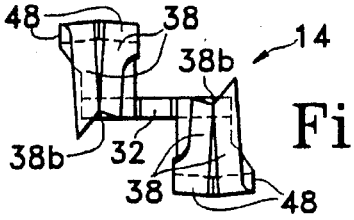
FIG. 15 is the top plan view of the connector in FIG. 14.
Figure 14:
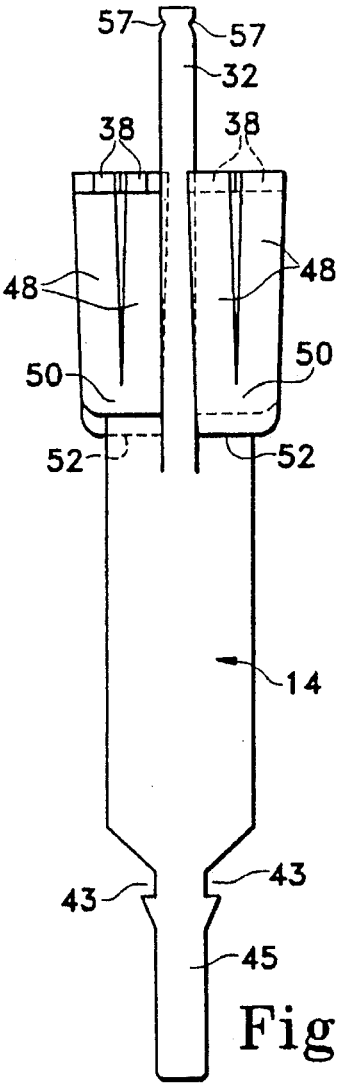
FIG. 14 is a side elevation of the connector of FIG. 2, as seen from the left of the connector in FIG. 2.
Figure 16:
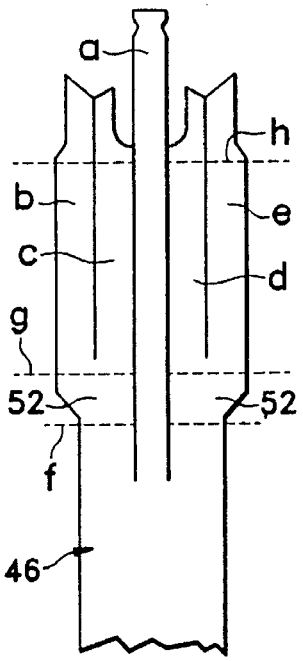
FIG. 16 is a fragmentary view of the blank used in making the connector in FIGS. 2, 14 and 15.

Connector 14 is shown in FIGS. 4, 14 and 15. It is formed of a blank 46, that appears in FIG. 16. Blank 46 is a strip of resilient sheet metal that is divided by four slits into a narrow central strip a and two pairs of fingers b–c and d–e at opposite sides of narrow strip a.

At dotted lines f, g and h, three nearly right-angle bends are formed in the left-hand pair of fingers b and c and mirror-image or reverse bends are formed in the right-hand pair of fingers, generally resulting in the connector of FIGS. 4, 5, 14 and 15.

Connector 14 includes two pairs of wire-gripping finger portions 38 divided by transverse bends 47 from support finger portions 48. Wire-gripping finger portions 38 are disposed approximately in a plane transverse to narrow strip a (FIG. 16) that becomes elongated pivot 32. The slits that divide pairs of support finger portions 48 from each other do not extend to bend g, i.e., the lowermost end of each support finger portion 48 extends fixedly from an undivided area 50 of the metal strip. In turn, undivided areas 52 of the metal strip extend step-like from areas 50.

As seen in FIGS. 14 and 15, and in several others, each support finger portion 48 diverges upward in relation to its companion support finger portion 48, from the lower end of each dividing slit. Wire-gripping finger portions 38 converge to a point of mutual contact 38*b* from the bend at which they extend from support finger portions 48. The purpose and quality, and the manner of developing this condition, will be clear from the following discussion of FIGS. 17–22.

FIGS. 17 and 18 show known forms of IDC's or insulation displacement connectors. Each involves a metal strip divided into a pair of fingers 54 (FIG. 17) and 56 (FIG. 18) having wire-gripping edges. In use, an insulation-sheathed wire is first placed broadside in the notch formed by the converging end portions of the paired fingers. The wire is then driven between their wire-gripping edges. Insulation is stripped from the wire in this process, and the locally bared wire is gripped between the mutually opposite edges of the fingers. The widths of the fingers resist spreading of those fingers, resulting in powerful-insulation displacing force applied to the insulation-sheathed wire. In the form of connector in FIG. 17, there is a hole 58 which reduces the widths and stiffness of the legs that support the wire-gripping edges of the fingers.

FIG. 19 illustrates a further known form of split-finger connector having two pairs of insulation displacement fingers 56'—56' at its ends, for connecting two wires together.

Referring to FIG. 2, wires are inserted vertically into the novel connecting device 20 and then rotor 16 forces the wires broadside, in a horizontal motion, against the ends 38*a* of wire-gripping finger portions 38. Most of connector 14 extends vertically from base 10. The horizontal wire-gripping finger portions 38 extend transversely from the upright portion of connector 14. FIG. 20 illustrates a first step toward creating the connector 14 of connection device 20.

In FIG. 20, strip 61 is slit partway along its length to create a pair of fingers. Those fingers are bent to provide short wire-gripping portions 62 and support finger portions 60 between the unslit portion of strip 61 and the wire-gripping finger portions 62.

Wire W is to be forced, broadside, from the position shown in FIG. 20 into a position gripped between finger portions 62. Wire W tends to drive the tips of portions 62 apart, as indicated by the arrows in FIG. 20; in this motion, portions 62 act as short levers that twist portions 60. This twisting leverage (not found in the connectors of FIGS. 17 and 18) reduces significantly the force of finger portions 62 acting to bare the conductor of wire W locally and to grip the locally bared areas of the wire's conductor. FIG. 21 illustrates a method and its result for enhancing greatly the gripping force of finger portions 62 of FIG. 20.

A connector having a pair of wire-gripping fingers is shown in FIG. 21, representing the wire-gripping fingers in FIGS. 2–16. Primed numerals are used in FIG. 21 for elements that correspond to like-numbered elements in FIGS. 2–16. Wire-gripping finger portions 38' have end formations 38*a'* that converge toward wire-gripping edges of finger portions 38', forming a wire-receiving recess at the free ends of the fingers. Support finger portions 48' are upright; at their lower ends, support finger portions 48' extend from undivided or unslit areas 50' of the metal strip. Areas 50' form a large obtuse angle in relation to each other, imposing firm mutually opposite twists on the lower ends 48* of support finger portions 48'. A deformation 52' provides a transition between the flat strip 14' and the angularly related areas 50'. The end result is to pre-bias wire-gripping finger portions 38' toward each other. The wire-gripping edges bear against each other at a point of contact 38*b'*. A narrow gap develops between wire-gripping finger portions 38' and between support finger portions 48'; the gap is greatest at bends 47'. The gap is narrower than the thickness of wires to be gripped between the mutually opposite edges of finger portions 38'. The described twists of the lower ends of the support finger portions results in remarkably firm pre-bias of the finger portions toward each other near their free ends 38*a'*. The ends of wire-gripping finger portions 38' at the upper ends of support finger portions 48' provide the same kind of firm pressure against an inserted wire as is developed by fingers of insulation displacement connectors of otherforms as in FIGS. 17 and 18. The same pre-bias of the wire-gripping edges 38' toward each other may be achieved by developing twists in support fingers 48'.

The separation between the mutually opposite edges of wire-gripping finger portions 38 provides its own benefit: those wire-gripping edges can be—and are—electroplated with a metal such as tin or gold for corrosion protection and low contact resistance between a gripped wire and the wire-gripping edges of finger portions 38.

Illustrative dimensions of the connector 14 (FIGS. 4, 14 and 15) may promote a better appreciation of some of the factors involved. Connector 14 in its finished form fits into a cavity in hollow post 12. As viewed endwise in FIG. 15, the connector is approximately ¼ inch by ¼ inch. The metal strip is of hardened resilient copper having about 90,000 ksi yield strength and thickness of about 0.025 inch. The length of support finger portion 48 is 0.25 inch (along the dividing slit as seen in FIG. 14) and the length of the opposed edges of wire-gripping finger portions (from point-of-contact 38*b* to the remote surface of the wire-gripping finger portion) is 0.11 inch. At bends 47 that divide finger portions 38 and 48, the gap between the fingers is about 0.012 inch. Finger portions 38 are of unequal widths, the inner ones being 0.025 inch wide and the outer ones being 0.034 inch wide. Support portions 50 are 0.10 inch wide. Post or pivot 32 is 0.025 inch thick by 0.040 inch wide. Points of contact 38*b* are diametrically opposite to each other in relation to pivot 32 (FIG. 15) in the plane transverse to pivot 32. Connectors having these proportions are highly effective with #22 and #24 solid wire (0.025 and 0.020 inch diameters). With appropriate dimensions this form of connector is also effective for stranded wire.

Referring to FIGS. 2–4, a conical recess 54 is formed in the upper end of rotor 16 which is of molded insulation, and post or pivot 32 projects into that recess. Notches 54 are formed in the edges of post 32 close to its tip. These notches are accessible for the jaws of a test clip, when required. In any case, posts 32 are exposed at the end of electrical connection device 20. When many devices 20 are integrated into a panel 22 of FIG. 1,, a test block having a standardized pattern of resilient test contacts can be used to engage all the connectors 14 of the panel.

Connection devices 20 of panel 22 may be close-spaced, and those devices are all available for wiring. None of the connection devices limits access to the other connection devices. Accordingly, a panel 22 can be shipped to the field in condition for use, with all of its rotors 16 in their "open" condition and in condition to receive wires.

The rotor 16 is useful to drive a wire into its gripped condition between finger portions 38, clearing insulation away from areas of the wire's conductor. The rotor has the further capability of removing wires from the grip of finger portions 38, by turning the rotor reversely.

The described connection devices may be used for connecting two party lines to a main line having a wire-wrap connection to terminal 45. The same panel may be used for private-line circuits, one pair of wire-gripping finger portions 38 not being used. The connection devices 20 of a single panel can by used, as needed, for either private lines or for two-party lines.

The insulation displacement connector 14', shown somewhat diagrammatically in FIG. 21, is particularly useful with a pivot 32 for a wire-driving rotor 16, where the pivot is formed of the same metal strip as that which provides a wire-gripping IDC. However, the connector 14' has wider usefulness. Similar to the connector of FIG. 19, a dual connector of the form in FIGS. 21 and 22 may be used as in FIG. 23, having pairs of wire-gripping portions 38' at its opposite ends.

The connection device 20 of FIGS. 2–15 has a rotor 16 that acts in its wire-inserting stroke to cause two wires to be gripped, and the rotor is operative in a reverse wire-releasing stroke to release both gripped wires. FIGS. 24–26 show a modified rotor 16' that is the same in all respects as rotor 16, with one exception. Rotor 16' is described here only to the extent required for expressing the difference of rotor 16' from rotor 16.

Rotor 16' has one hole 34' having both a "back" driving portion 34*a'* for driving a wire clockwise (as seen in FIGS. 8 and 24) to force the wire between the edges of a pair of wire-gripping finger portions 38, and a "front" driving portion 38*b'* for driving an inserted wire counterclockwise (FIGS. 8 and 24) to force the wire out of the grip of wire-gripping portions 38, to release the wire.

In FIGS. 24–26, the second hole 34 of FIGS. 6–12 is replaced by a hole 134. Hole 134 has a "back" portion 134*a* that serves the same purpose as hole portions 34*a* and 34*a'*, to drive a wire into wire-gripping finger portions 38. "Front" portion 134*b* of hole 134 is spaced away from "back" portion 34*a'* far enough so that, when rotor 16' is operated through its wire-releasing stroke, a wire previously inserted by "back" hole portion 34*a'* into a pair of wire-gripping finger portions 38 remains gripped and undisturbed. That wire will remain connected to the wire that is secure to the wire-wrap terminal 45 of connector 14.

A connection device 20, modified to incorporate rotor 16' has the further advantage that, where only one wire is inserted, it can be inserted into either hole 34' or hole 134. In that way, the same connection device can be used in either of two applications, one in which the wire-release mode of operation is desired, and another in which the wire is not to be released.

In a still further alternative, both holes 34 of FIGS. 6–12 can be replaced by holes 134 so that, once a wire has been gripped by finger portions 38, it will not be disturbed by a reverse stroke of the rotor.

The illustrative embodiment of the invention of FIGS. 1–16, 21 and 22 involves electrical connectors (FIGS. 14 and 15) that have a single wire-wrap terminal in common for two pairs of wire-gripping finger portions 38.

The second illustrative embodiment of the invention, shown in FIGS. 27–46, has a separate wire-wrap terminal 145 for each pair of wire-gripping finger portions 138.

In referring to elements of the second embodiment, 100-series numerals are used generally in referring to elements that correspond to like elements of the first embodiment. For example, bends 47 (FIG. 21) and 147 (FIG. 44) divide "support finger portions" 48 and 148, respectively, from "wire-gripping finger portions" 38 and 138. Pre-bias of the wire-gripping finger portions 38 and 138 toward each other is developed in the same way and for the same purposes in both embodiments of the invention.

Referring to FIGS. 27–46, and in particular to FIGS. 27–30, panel 122 including base 110 has multiple rows and columns of dual connection devices 120, each of which includes two hollow posts 112, each post containing an electrical connector 114. A rotor 116 of molded plastic insulation is pivotally, mounted on base 110, above and between hollow posts 112.

Figure 40:
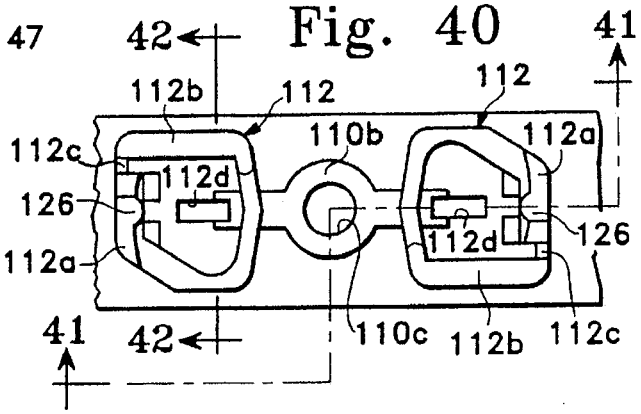
Figure 42:
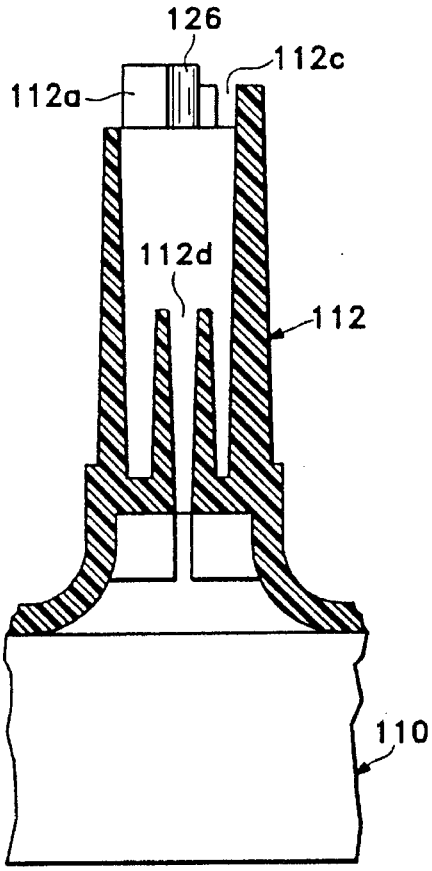
Figure 41:
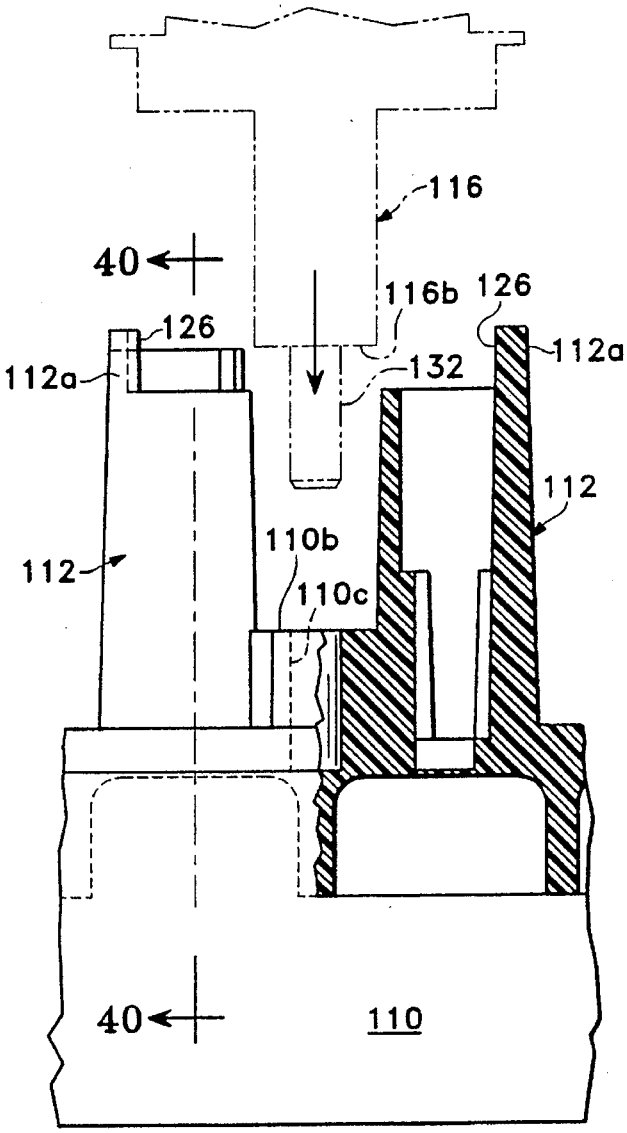

FIGS. 40 and 41 show a pair 6f hollow posts 112 of molded insulation that project upward integrally from molded base 110 of insulation. Each post 112 has an upward projection 112*a* bearing a semi-cylindrical detent 126. Each such detent is receivable in one or another of a pair of half-cylindrical recesses 126*a*, 126*b* of rotor 116, in accordance with whether the rotor is in its wire-receiving or wire-gripping position.

The upward projection 112*a* of one hollow post 112 is spaced by a fixed distance from the projection 112*a* of the companion hollow post 112. Rotor 116 is divided by a deep slot 116*a* in such manner that the portions of the rotor having recesses 126*a* and 126*b* can be squeezed toward each other resiliently as the rotor is shifted by turning a screwdriver in slot 128, driving one recess 126*a* or the other 126*b* out of mating fit with one of the convex projections 126. Deep slot 116*a* develops a long surface creep distance, hence a large value of electrical resistance, between portions of the rotor that engage the inserted wires.

Figure 29:
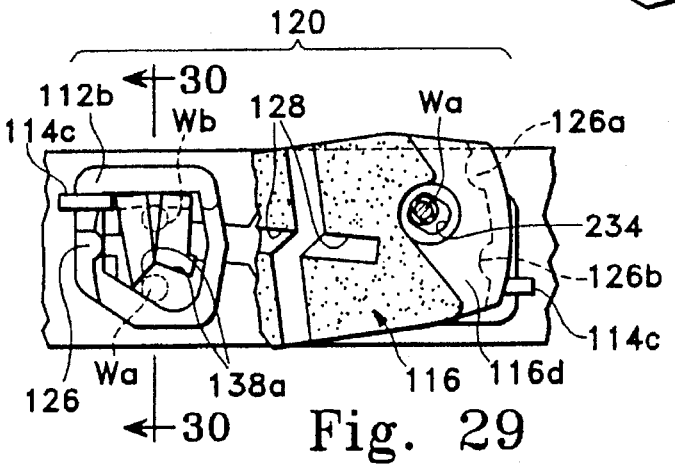
Figure 46:
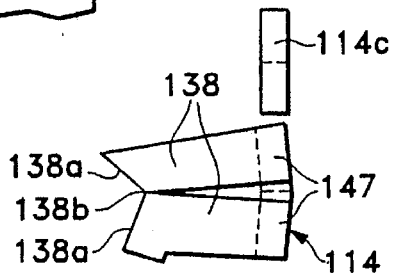
Figure 28:
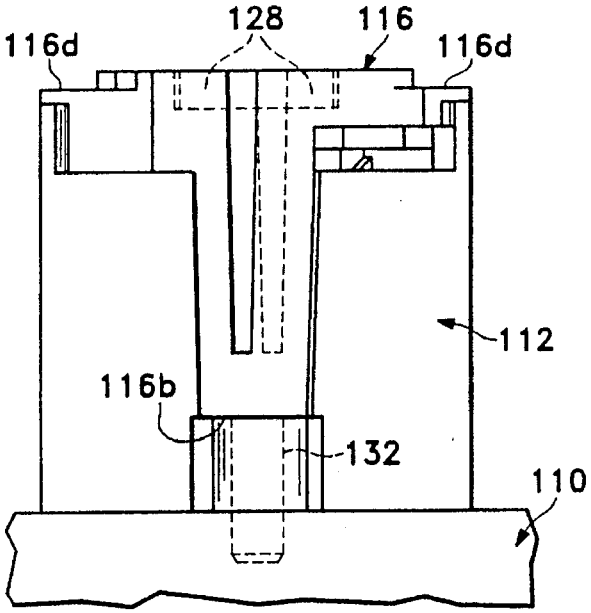
Figure 30:
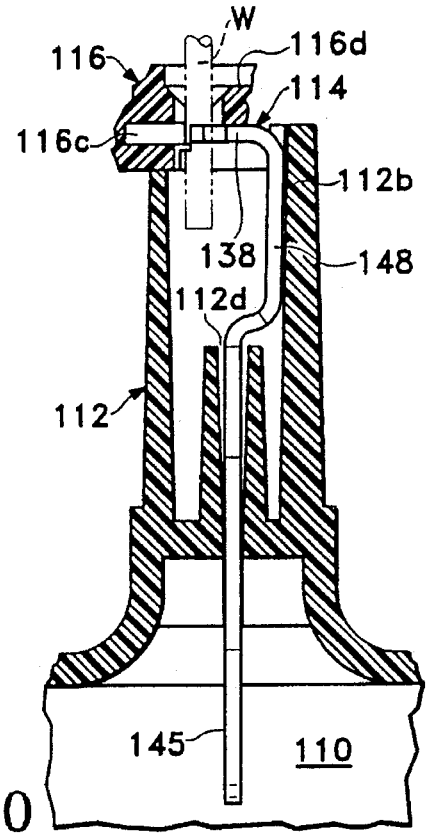
Figure 33:
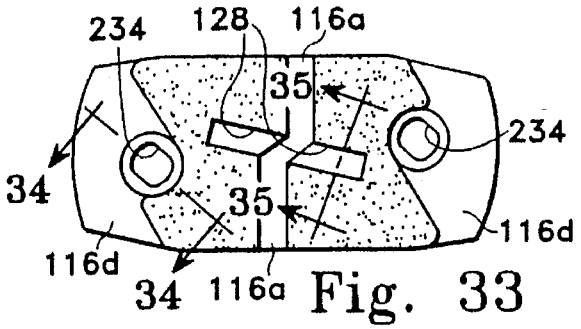
Figure 35:
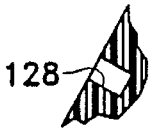
Figure 34:
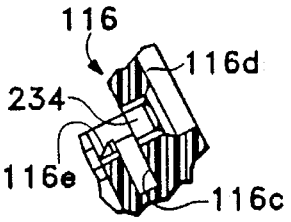
Figure 31:
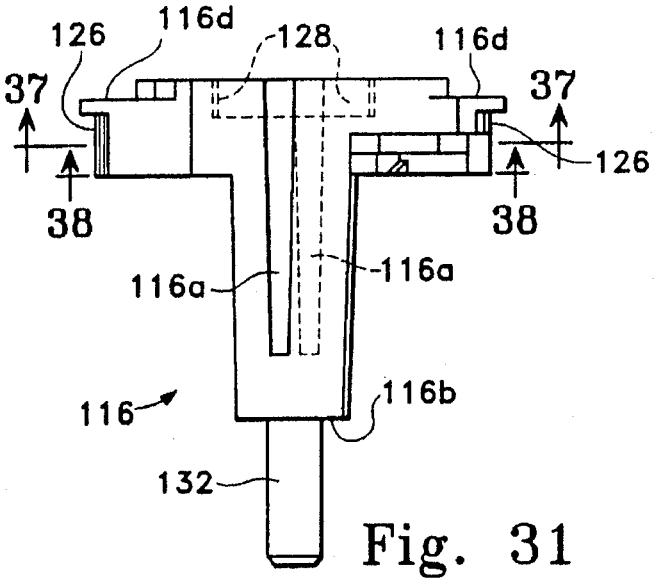
Figure 32:
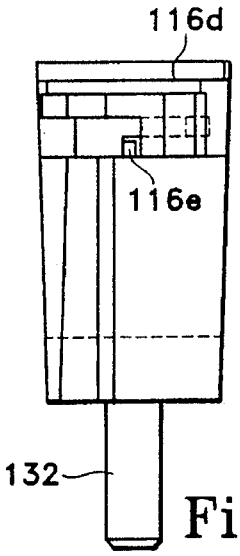
Figure 36:
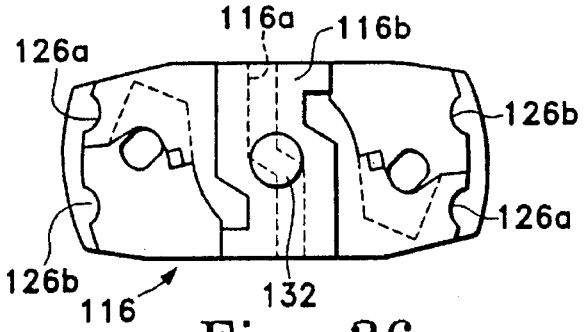
Figure 38:
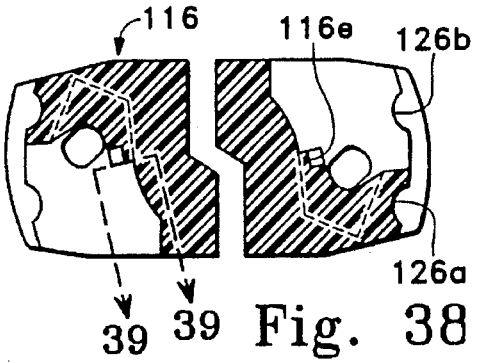
Figure 37:
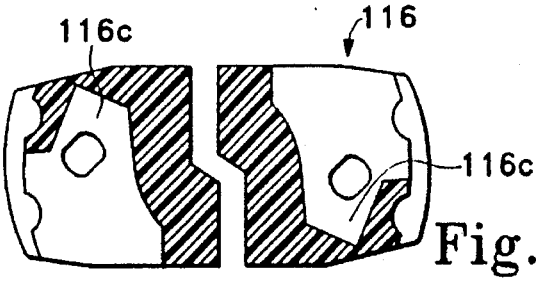
Figure 39:
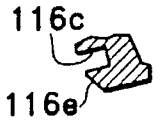
Figure 43:
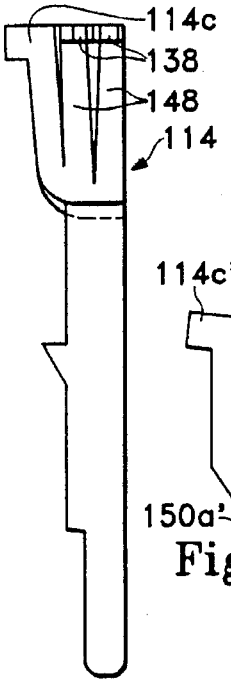
Figure 44:
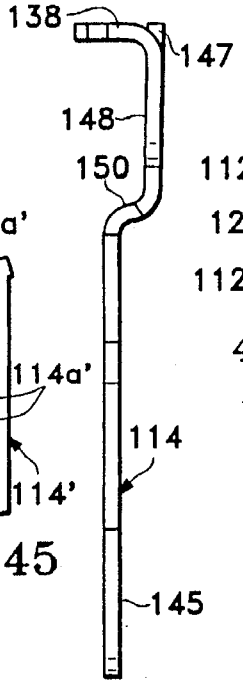
Figure 45:
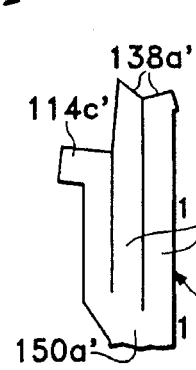

Electrical connector 114 (FIGS. 29, 30, 43, 44, in each hallow post 112 has a pair of wire-gripping finger portions 138. For each post 112, rotor 116 has a respective wire-receiving hole 234. These holes are slightly elongated, i.e. roughly oval, so that, as a screwdriver forces the rotor to turn and causes the portions of the rotor which are divided by deep slot 116*a* to be squeezed toward each other, each wire W in elongated hole 234 can shift to the appropriate portion of its hole. Additionally, as each wire W is driven from a position Wa at which it is inserted (FIG. 29), and against the sharp edges 138*a* at the ends of wire-gripping finger portions 138 (FIG. 29), the insulation on the inserted wires is penetrated. The conductor of wire W is bared locally where it is gripped by wire-gripping finger portions 138 (FIGS. 29 and. 46) as the wire reaches position Wb (FIG. 29).

Referring to FIGS. 43–46, electrical connector 114 is formed of resilient sheet metal that is a flat blank 114' at one stage of manufacture; it is divided by slits into elongated fingers 114*a'*, and the free ends are formed by die-cutting. As a result, the edges 138*a* ' and the slit edges of fingers 114*a'* are sharp. As in the steps of making the electrical connector of FIGS. 14–16, portion 150' of the sheet metal blank is so deformed that the slit or shear-cut wire-gripping finger portions. 138 bear against each other at their free ends 138*b* and a separation develops between the wire-gripping edges of finger portions 138. This separation is greatest at bends 147. The result is that a considerable amount of pre-bias develops, forcing the wire-gripping finger portions against each other at point of contact 138*b*. That pre-bias presses the free ends of the wire-gripping fingers together, augmenting the forces available to cause penetration of the insulation on the wire. The basic consideration is that reverse twists develop in the upstanding finger portions 148 (FIGS. 30 and 44) that support the wire-gripping finger portions 138. These twists can be created by permanent deformations in area 150*a'* or in support finger portions 148 preferably close to the undivided portion 150*a'* of the sheet metal blank. In a more cumbersome procedure, temporary resilient twists may be imposed on portions 148 and bends 147 may then be made in fingers 114*a'* at mirror-image angles of 94° (for example), such that the finger portions 138 engage each other at points 138*b*. The temporary twists in portions 148 remain in effect thereafter, providing the desired pre-bias of wire-gripping portions toward each other at and near their free ends.

The cut edges 138*a* and the slit or sheared edges of the wire-gripping finger portions 138 are forcibly engaged by the insulation on inserted wires W as the rotor forces the wires from their positions Wa (FIG. 29) as inserted into rotor 116 to end positions Wb. The result is that the insulation is so severely displaced that the wire-gripping edges of finger portions 138 engage the locally bared center conductors of the inserted wires.

Electrical connector 114 has a test contact portion 114*c* received in 112*c* of each post 112. As seen in FIG. 29. Test contact 114*c* projects from notch 112*c* and it is considered above for making test connection, like post 32 that is considered above.

Electrical connector 114 also has a wire-wrap terminal 145 in base 110, for each pair of wire-gripping finger portions 138.

As seen in FIG. 41, base 110 includes a bearing portion 110*b* and a hole 110*c* between each pair of hollow posts 112. Pivot 132 Of rotor 116 is received in hole 110*c*, and bearing area 116*b* of the rotor rests on surface 110*b*. As the rotor is turned by a screwdriver to drive a pair of wires from positions Wa to positions Wb, pivot 132 turns in hole 110*c* and surfaces 110*b* and 116*b* bear against each other. Wire-gripping finger portions 138 of connector 114 are received in slot 116*c* (FIG. 30 and FIG. 34) of the rotor as the rotor is turned.

The uppermost surface of the rotor (stippled in FIG. 33) is relieved in the areas 116*d* leading to holes 234. Insertion of a wire W into a hole 234 is facilitated by the provision of relieved areas 116*d*; when a wire is to be inserted into a hole 234, the wire's end is abutted against area 116*d* and swept toward the raised (stippled) area at the top of the rotor until the wire enters the hole. Note that (FIG. 33) the hole 234 is at a place where the relieved area 116*d* ends, at a margin of the raised area.

When a dual connector is to be assembled, one electrical connector 114 is driven into each passage 112*d* in hollow posts 112. Rotor 116 is inserted, as indicated by the phantom lines in FIG. 41. At the end of the insertion stroke, two cam surfaces 116*e* of the rotor engage and deflect respective wire-gripping finger portions 138 (FIG. 34) which snap into recesses 116*c* in the rotor. Accordingly, a recess 116*c* of the rotor and a wire-gripping finger portions 138 become interengaged in such a manner that rotor 116 is latched and retained in assembly to the base-and-hollow-post structure.

The action of rotor 116 in driving wires into engagement by the wire-gripping finger portions 138 of the electrical connectors is essentially the same as in the embodiment of FIGS. 1–16. Considering FIG. 30 and the left part of FIG. 29, pressure applied to wire W by the rotor forces the wire against the electrical connector, first against die-cut edges 138*a* (FIGS. 29 and 44) which edges converge to a point of contact 138*b* of the wire-gripping finger portions 138, and then wire W is forced between the slit edges of wire-gripping finger portions 138. As this occurs, the sharpness of the die-cut ends 138*a* and the sharpness, of the slit edges of wire-gripping finger portions 138 cause the insulation on wire W to be penetrated, thereby baring the center conductor of wire W for engagement by the wire-gripping finger portions. The driving force of the wire against electrical connector 114 is effective for driving the wire into gripped retention at position Wb (FIG. 26) of the wire-gripping finger portions 138 of the electrical connector.

Driving the wire against the electrical connector also drives the connector against a wall 112*b* of the hollow post. Forced rotation of rotor 116 drives a wire between wire-gripping finger portions 138 to position Wb. The force applied is to overcome the resistance of wire-gripping portions 138 against being spread sufficiently for the center conductor of the wire to be received between the wire-gripping edges, and the force needed for the sharp die-cut and slit edges of wire-gripping finger portions 138 to deform and displace the electrical insulation locally, where the wire-gripping edges directly grip the center conductor of the wire.

Release of both wires retained by each dual connection device 120 is effected by reverse rotation of rotor 116, using a screwdriver in slot 128. Each electrical connector 114 is retained in position by various formations in hollow post 112; test contact portion 114*c* in slot 112*c* contributes to the positioning of connector 114. The stiffness of the connector and its retention in position in post 112 provide sufficient restraint of connector 114 against being dragged with wire W, as the rotor forces each wire toward a position Wa where the wire becomes free of the wire-gripping edges.

The embodiments of the invention in its various aspects, as discussed and described above and as shown in the drawings, are subject to a wide range of variation, and some portions of the novelty may be used without others. Consequently, the invention should be construed broadly in accordance with its true spirit and scope.

What is claimed is:

1. The method of making an electrical connector including the steps of dividing a strip of resilient sheet metal partway along its length by slitting the strip in such manner as to form a pair of fingers extending from and joined by an unslit portion of the strip wherein the fingers have free ends and mutually opposite edges, and deforming the slit strip in such a manner as (a) to divide the fingers into a pair of support finger portions extending from and joined by said unslit portion of the metal strip and a pair of wire-gripping finger portions extending substantially transversely from said support finger portions, respectively, to the free ends of the fingers in such a manner that portions of said mutually opposite edges of the fingers constitute wire-gripping edges of said wire-gripping finger portions, and (b) to develop twists in said support finger portions in mutually opposite directions such that the wire-gripping edges of the wire-gripping finger portions bear forcibly against each other, when nothing is interposed therebetween, at a point spaced substantially from said support finger portions.

2. An electrical connection device including a base of insulation, an electrical connector, and a rotor, said connection device having means for constraining said rotor to turn about an upright axis, said electrical connector including a strip of resilient sheet metal divided by being slit partway along its length into a pair of fingers extending from and joined by an unslit portion of said strip, said fingers having free ends and mutually opposite edges, said divided strip of resilient sheet metal being deformed so as to constitute means for:

(a) dividing said fingers, respectively, into a pair of support finger portions extending from and joined by said unslit portion of the metal strip and a pair of wire-gripping finger portions extending substantially transversely from said support finger portions to said free ends and having mutually opposite wire-gripping edges constituted of portions of the mutually opposite edges of said fingers, and (b) developing twists in mutually opposite directions in said support finger portions in such manner as to cause said wire-gripping edges to bear forcibly against each other at a point spaced substantially from said support finger portions when nothing is interposed therebetween, said strip of resilient sheet metal being secured to said base, said wire-gripping finger portions being spaced from and transverse to said axis and being disposed for gripping a wire at least approximately parallel to said axis, said rotor having a wire-driving portion operative in a wire-inserting stroke of the rotor for forcing a wire broadside from a position opposite to said free ends of said wire-gripping finger portions and at least approximately parallel to said axis to a position between said wire-gripping edges.

3. A dual connection device including a base of insulation, two electrical connectors of sheet metal fort making connection to two inserted wires, respectively, each of said connectors including a pair of side-by-side elongated fingers divided by bends into a pair of upstanding support finger portions and a pair of wire-gripping finger portions extending to free ends from said bends, said pairs of wire-gripping finger portions being disposed in a plane, and a rotor of insulation pivoted to said base and adapted to turn about an axis perpendicular to said plane, said rotor having driving portions for forcing respective wires from initial positions opposite said free ends to positions gripped by said pairs of wire-gripping finger portions, respectively.

4. A dual connection device as in claim 3, wherein a gap is provide in said rotor between said driving portions for developing an extended surface creep distance between said driving portions of the rotor.

5. A dual connection device as in claim 3, wherein each of said connectors has a separate wiring terminal under the base.

6. A connector as in claim 3, wherein said rotor is incompletely divided by a gap into two rotor portions having a resilient interconnection, and wherein said base of insulation has rigidly spaced-apart detents cooperable with detent formations of said two resiliently connected portions of said rotor for restraining said rotor releasably either in position to receive inserted wires opposite to said free ends, or in position gripped by said pairs of wire-gripping finger portions.

7. An electrical connection device including a support of insulation, an electrical connector, and a rotor, and means for constraining said rotor to turn about an axis upright with respect to said support, said electrical connector comprising an elongated metal strip divided partway along its length to form a pair of fingers extending side-by-side from an undivided portion of the strip to free ends, said fingers being divided by transverse bends to constitute a pair of side-by-side upright support finger portions extending from said undivided portion of the strip to said bends and a pair of wire-gripping finger portions transverse to and offset from said axis and extending from said bends to said free ends of the fingers, respectively, said wire-gripping finger portions having wire-gripping edges and being related to the axis of the rotor and to each other for admitting a wire disposed in an initial position at least approximately parallel to and offset from said axis and opposite to said free ends and for the wire to be driven by the rotor into an inserted position gripped by and between said wire-gripping finger portions, said rotor having a wire-driving portion operable in a wire-insertion stroke for forcing a wire from said initial position to said inserted position.

8. An electrical connector as in claim 7, wherein said metal strip is permanently deformed so as to impose mutually opposite twists on said support finger portions so as to cause the wire-gripping finger portions to be biased forcibly towards each other at a point of contact remote from said bends.

9. An electrical connection device as in claim 7, wherein said means for constraining said rotor to turn about said axis includes mutually cooperating bearing surfaces of said rotor and said insulating means.

10. An electrical connection device as in claim 7, wherein a deformation is formed in or close to said undivided area where ends of said support portions adjoin said undivided portion, said deformation acting to twist said support ends in such a manner as to cause the wire-gripping finger portions to be biased forcefully toward each other at a point remote from said bends and to cause said wire-gripping finger portions to be spaced apart elsewhere.

11. An electrical connection device as in claim 7, wherein said support of insulation further includes means for restraining said wire-gripping finger portions against being deflected by a wire that is gripped while being moved, both during said wire-inserting stroke and during a reverse wire-removal stroke of the rotor.

12. An electrical connection device as in claim 7, wherein said wire-gripping finger portions and their free ends incorporate means for displacing insulation locally from the inner conductor of an insulation-sheathed wire and for establishing contact of the wire-gripping edges with the locally bared inner conductor when the wire is driven by said rotor against said free ends and between said wire-gripping finger portions.

13. An electrical connector as in claim 7, wherein said support finger portions embody mutually opposite twists such as to cause said wire-gripping finger portions to bear forcibly against each other at a point of contact spaced substantially from said bends, when nothing is interposed between the wire-gripping finger portions.

14. An electrical connection device as in claim 7, wherein portions of said support of insulation provide means for blocking said wire-gripping finger portions against being displaced with a wire that is being driven by said rotor in its wire-inserting stroke.

15. An electrical connection device as in claim 14, for making electrical connection to a wire which has a sheath of insulation on a center conductor, wherein said connector is formed so as to cause said free ends of said fingers to penetrate said insulating sheath of said wire and so as to bare portions of said center conductor of the wire for engagement by said wire-gripping edges when said rotor is being operated in said wire-inserting stroke.

16. An electrical connection device as in claim 14, wherein said free ends of said wire-gripping finger portions are so shaped and so related to each other that, when a wire having insulation covering and an inner conductor is carried by said driving portion of the rotor in its wire-inserting stroke against said free ends and between said wire-gripping finger portions, the inner conductor is bared of insulation locally for engagement with said wire-gripping edges.

17. An electrical connection device as in claim 7, wherein said rotor is formed of insulation and has a hole in its axial end for exposing an area of said connector for engagement by a test probe.

18. A connection panel wherein multiple electrical connection devices as in claim 17 are unified on a common base so that said exposed area of the connectors of said connection devices form a pattern of contacts engageable by a pattern of test contacts of a test block.

19. An electrical connection device as in claim 13, wherein said metal strip is divided along part of its length to have two elongated contact portions each of which has an undivided portion and a pair of elongated fingers, each pair of fingers of said two elongated contact portions of the strip replicating the fingers as set forth in claim 13, one of said pairs of fingers constituting the pair of fingers of claim 13 and the other of said pairs of fingers constituting a second pair of such fingers, the free ends of the fingers of each pair being spaced apart arcuately about said axis from the free ends of the other pair of fingers and the wire-gripping finger portions of both pairs of fingers extending in the same rotational direction from the free ends of their respective pairs of fingers.

20. An electrical connection device including a base of insulation, an electrical connector, and a rotor, and means constraining the rotor to turn about an axis-upright relative to said base, said electrical connector comprising a metal strip secured to said base and being longitudinally divided to include an elongated pivot for said rotor upright relative to said base and, at opposite sides of said pivot, first and second elongated connector portions, each of said connector portions being longitudinally divided along at least part of the length thereof, so as to form first and second pairs of fingers having respective pairs of wire-gripping finger portions, the wire-gripping finger portions of each of said connector portions being spaced from the axis of said elongated pivot and disposed transverse to said axis, said wire-gripping finger portions of each of said connector portions having mutually opposite edges disposed for gripping an upright wire therebetween and end formations that form a recess whose edges converge toward said mutually opposite edges, and said rotor having wire-driving portions operative in a wire-inserting angular stroke of the rotor for forcing two upright wires broad-side against the respective end formations of the wire-gripping finger portions of said first and second connector portions and for forcing the upright wires between said mutually opposite wire-gripping edges of the respective first and second pairs of wire-gripping finger portions.

21. An electrical connection device as in claim 20, wherein the rotor has a wire-removing portion relative to only one of said pairs of wire-gripping finger portions, said wire-removing portion constituting means, operative in the wire-removing stroke of the rotor, for withdrawing one wire from one of said pairs of wire-gripping finger portions while, despite operation of the rotor in a wire-removing stroke, one of a pair of previously inserted wires remains gripped by one of said pairs of wire-gripping finger portions.

22. A connection panel wherein multiple electrical connection devices in accordance with claim 20 are carried by said base, the rotors being apertured to expose the respective pivots of the connectors thereof for enabling test contact to be made to each electrical connector.

23. An electrical connector comprising an elongated resilient sheet metal strip slit partway along its length to form a first pair of elongated fingers having mutually opposite cut edges and extending to free ends and having respective support ends extending from and joined by an unslit portion of the metal strip, said fingers being divided by at least approximately transverse bends into a pair of side-by-side support finger portions extending between said support ends of the fingers and said bends, respectively, and a pair of side-by-side wire-gripping finger portions extending substantially transverse to said support finger portions from said bends to said free ends, respectively, said wire-gripping finger portions having mutually opposite elongated wire-gripping cut edges constituted of portions of the mutually opposite cut edges of the fingers, said support finger portions embodying mutually opposite sustained twists related to each other so as to cause the wire-gripping finger portions to bear with substantial force against each other at a point spaced substantially from said bends, when there is nothing interposed between the wire-gripping finger portions, and to cause the fingers to be spaced apart elsewhere.

24. An electrical connector as in claim 23, wherein said free ends of the fingers, also being the free ends of the wire-gripping finger portions, have edges that converge toward said mutually opposite cut edges, the stiffness of said fingers and the bearing force of the fingers against each other being related in such a manner that, when wire having a central conductor and a sheath of insulation is forced broadside at said converging edges and between said wire-gripping finger portions, the insulation is displaced locally and the central conductor is bared for engagement by said wire-gripping finger portions.

25. An electrical connection device including an electrical connector and a driver for forcing a wire into assembly with said connector, and means for maintaining said driver assembled to said electrical connector, said electrical connector including a strip of resilient sheet metal divided by being slit partway along its length into a pair of fingers extending from and joined by an unslit portion of said strip, said fingers having free ends and mutually opposite cut edges, said fingers having bends that divide the fingers into a pair of support finger portions extending to said bends from said unslit portion of the metal strip and a pair of mutually opposite wire-gripping finger portions extending substantially transversely from said support finger portions to said free ends and having mutually opposite wire-gripping edges constituted of portions of the mutually opposite cut edges of said fingers, and said support finger portions embodying twists in mutually opposite directions such as to cause said wire-gripping finger portions to bear forcibly against each other at a point spaced substantially from said support finger portions when nothing is interposed between the wire-gripping finger portions and such twists causing the wire-gripping finger portions to be spaced apart elsewhere, and said driver having means for driving a wire broadside from a position opposite to the free ends of the wire-gripping finger portions to an inserted position between and gripped by said wire-gripping finger portions.

26. An electrical connection device as in claim 25, wherein said driver is a rotor mounted for operation about an imaginary axis and having a wire-driving portion offset from said axis and wherein said wire-gripping finger portions and said free ends are correspondingly offset from said axis, arranged so that a wire, when disposed at said free ends, may be driven by said wire-driving portion broadside between said wire-gripping edges.

27. An electrical connection device as in claim 20, wherein each of said connector portions has a pair of side-by-side upright support finger portions extending to a respective pair of said wire-gripping finger portions.

28. An electrical connection device as in claim 27, wherein said base of insulation further includes means for restraining respective pairs of said wire-gripping finger portions against being moved in the wire-insertion direction during said wire-inserting stroke of the rotor.

29. An electrical connector comprising an elongated resilient sheet metal strip slit partway along its length in such a manner as to form a first pair of side-by-side elongated fingers having mutually opposite cut edges, said fingers extending to free ends and extending from and joined by an undivided area of the metal strip, said fingers being divided by at least approximately transverse bends into a pair of support finger portions extending between said undivided area of the strip and said bends, respectively, and a first pair of side-by-side wire-gripping finger portions extending substantially transverse to said support finger portions from said bends to said free ends of the fingers, respectively.

30. An electrical connector as in claim 23, further including a second electrical connector replicating that of claim 23, said free ends of the pairs of wire-gripping finger portions of said first and second connectors being disposed diametrically opposite each other relative to an imaginary center line, and a rotor whose axis extends along the center line, the rotor having a pair of wire-driving portions, the pairs of wire-gripping finger portions of said electrical connectors being related to each other and to said rotor so that driving the rotor and its wire-driving portions in a wire-insertion stroke is operative to force two wires broadside from initial positions opposite to the ends of the pairs of wire-gripping finger portions, respectively, into positions gripped by and between the pairs of wire-gripping finger portions of the first and second electrical connectors, respectively.

31. The method of making an electrical connector including the steps of slitting a strip of resilient sheet metal partway along its length so as to leave a portion of the strip unslit and so as to form a pair of fingers having free ends, the fingers extending from and being joined by said unslit portion of the strip and having mutually opposite cut edges; forming bends in said fingers to provide a pair of support finger portions extending to said bends from said unslit portion of the strip and to provide a pair of mutually opposite wire-gripping finger portions extending substantially transversely from said support finger portions to said free ends, and having mutually opposite wire-gripping edges, and said method including the step of imposing mutually opposite twists in said support finger portions in such a manner as to cause the wire-gripping finger portions to bear with substantial force against each other at a point spaced substantially from said bends when-nothing is interposed between the finger portions and to cause the mutually opposite edges of said wire-gripping finger portions to be spaced apart elsewhere.

32. An electrical connector including a strip of resilient sheet metal divided by being slit partway along its length into a pair of fingers extending from and joined by an unslit portion of said strip, said fingers having free ends and mutually opposite cut edges, said fingers having bends that divide the fingers into a pair of side by side support finger portions extending to said bends from said unslit portion of the metal strip and a pair of mutually opposite wire-gripping finger portions extending substantially transversely from said support finger portions to said free ends and having mutually opposite wire-gripping edges constituted of portions of the mutually opposite cut edges of said fingers, and each of said support finger portions embodying sustained twists in mutually opposite directions such as to cause said wire-gripping finger portions to bear forcibly against each other at a point spaced substantially from said support finger portions when nothing is interposed between the wire-gripping edges, and to cause the wire-gripping finger portions to be spaced apart elsewhere.

33. The method of making an electrical connector, including the steps of slitting an elongated resilient sheet metal strip partway along its length in such a manner as to form a pair of side-by-side elongated fingers having mutually opposite cut edges and said fingers extending to free ends from and joined by an undivided area of the strip, bending the fingers so as to form a pair of side-by-side support finger portions extending to said bends from said undivided area of the strip and a pair of side-by-side wire-gripping finger portions extending at least approximately transverse to said support finger portions from said bends to said free ends, respectively, said method including the step of imposing mutually opposite sustained twists in the support finger portions, the twists being related to cause the wire-gripping finger portions to bear forcibly against each other at a point spaced substantially from the bends when there is nothing between the wire-gripping finger portions, such twists causing the fingers to be separated elsewhere.

34. An electrical connection device for making connections to multiple inserted wires, said device including insulation means, a rotor, means for constraining said rotor to turn about an axis, and multiple contacts supported by said insulating means for making connection separately to multiple wires, said rotor having wire-insertion driving means effective when said rotor is turned in a forward stroke for driving multiple wires from respective starting positions opposite said contacts to respective connected positions engaged by said contacts, said rotor including wire-disconnecting means operative in a reverse stroke of the rotor for driving fewer than all of said multiple wires out of engagement with their respective contacts.

* * * * *